US010626355B2

(12) United States Patent
Zou et al.

(10) Patent No.: US 10,626,355 B2
(45) Date of Patent: Apr. 21, 2020

(54) COMPOSITION, ITS USE AND METHOD FOR REMOVING AND PREVENTING WET STRENGTH RESINS FROM CONTAMINATING PAPERMAKING EQUIPMENT

(71) Applicant: Kemira Oyj, Helsinki (FI)

(72) Inventors: Yong Zou, Atlanta, GA (US); Yuping Luo, Johns Creek, GA (US); Anna Casasús, Alpharetta, GA (US)

(73) Assignee: Kemira Oyj, Helsinki (FI)

( * ) Notice: Subject to any disclaimer, the term of this patent is extended or adjusted under 35 U.S.C. 154(b) by 105 days.

(21) Appl. No.: 16/018,287

(22) Filed: Jun. 26, 2018

(65) Prior Publication Data

US 2019/0002804 A1 Jan. 3, 2019

Related U.S. Application Data

(60) Provisional application No. 62/527,027, filed on Jun. 29, 2017.

(51) Int. Cl.
*C11D 11/00* (2006.01)
*D21F 3/02* (2006.01)
(Continued)

(52) U.S. Cl.
CPC ..... *C11D 11/0041* (2013.01); *C11D 3/046* (2013.01); *C11D 3/2068* (2013.01);
(Continued)

(58) Field of Classification Search
None
See application file for complete search history.

(56) References Cited

U.S. PATENT DOCUMENTS 3,772,078 A 11/1973 Polichette et al.
6,051,108 A * 4/2000 O'Neal, Jr. ..... D21F 1/32 162/199
(Continued)

FOREIGN PATENT DOCUMENTS

CN 105238586 A 1/2016
EP 1887027 A1 2/2008
(Continued)

OTHER PUBLICATIONS

Morr et al,"How Much Calcium Is in Your Drinking Water? A Survey of Calcium Concentrations in Bottled and Tap Water and Their Significance for Medical Treatment and Drug Admin",HSS J.,pp. 130-135,[online], retr.from Internet, Dec. 3, 2019, <URL:https://link.springer.com/content/pdf/10.1007%2Fs11420-006-9.PDF> (Year: 2006).*
(Continued)

*Primary Examiner* — Dennis R Cordray
(74) *Attorney, Agent, or Firm* — Berggren LLP

(57) ABSTRACT

Compositions and methods for cleaning wet strength resin contamination from papermaking equipment and/or for preventing wet strength resins from contaminating papermaking equipment using the compositions are disclosed. The compositions comprise an aqueous solution of a weak organic acid; a surfactant, preferably a nonionic surfactant, a divalent metal ion containing catalyst and optionally a glycol ether containing solvent.

18 Claims, 1 Drawing Sheet

(51) Int. Cl.

| | |
|---|---|
| ***D21H 17/55*** | (2006.01) |
| ***D21H 21/20*** | (2006.01) |
| ***C11D 3/20*** | (2006.01) |
| ***C11D 3/04*** | (2006.01) |
| ***D21H 21/02*** | (2006.01) |

(52) U.S. Cl.

CPC ..... *C11D 3/2086* (2013.01); *D21F 3/02* (2013.01); *D21H 21/02* (2013.01); *D21H 17/55* (2013.01); *D21H 21/20* (2013.01)

(56) References Cited

U.S. PATENT DOCUMENTS

| | | | |
|---|---|---|---|
| 6,696,399 | B1 | 2/2004 | Chernin |
| 8,470,755 | B1 | 6/2013 | Tajmamet et al. |
| 2012/0077725 | A1 | 3/2012 | Wang |
| 2013/0126113 | A1 | 5/2013 | Tan et al. |
| 2016/0145800 | A1 | 5/2016 | Loo |

FOREIGN PATENT DOCUMENTS

| | | | |
|---|---|---|---|
| JP | 2014130029 | A | 7/2014 |
| WO | 9732968 | A1 | 9/1997 |
| WO | 00006824 | A1 | 2/2000 |
| WO | 2008045096 | A1 | 4/2008 |

OTHER PUBLICATIONS

Braga et al, "Recent Developments in Wet Strength Chemistry Targeting High Performance and Ambitious Environmental Goals", Professional Papermaking, v. 3-4, 2009,pp. 30-34. (Year: 2009).*

International Search Authority, International Search Report for application PCT/FI2018/050500, dated Oct. 4, 2018, 5 pages.

Finnish Patent and Registration Office, Search report of FI10275707, dated Mar. 13, 2018.

* cited by examiner

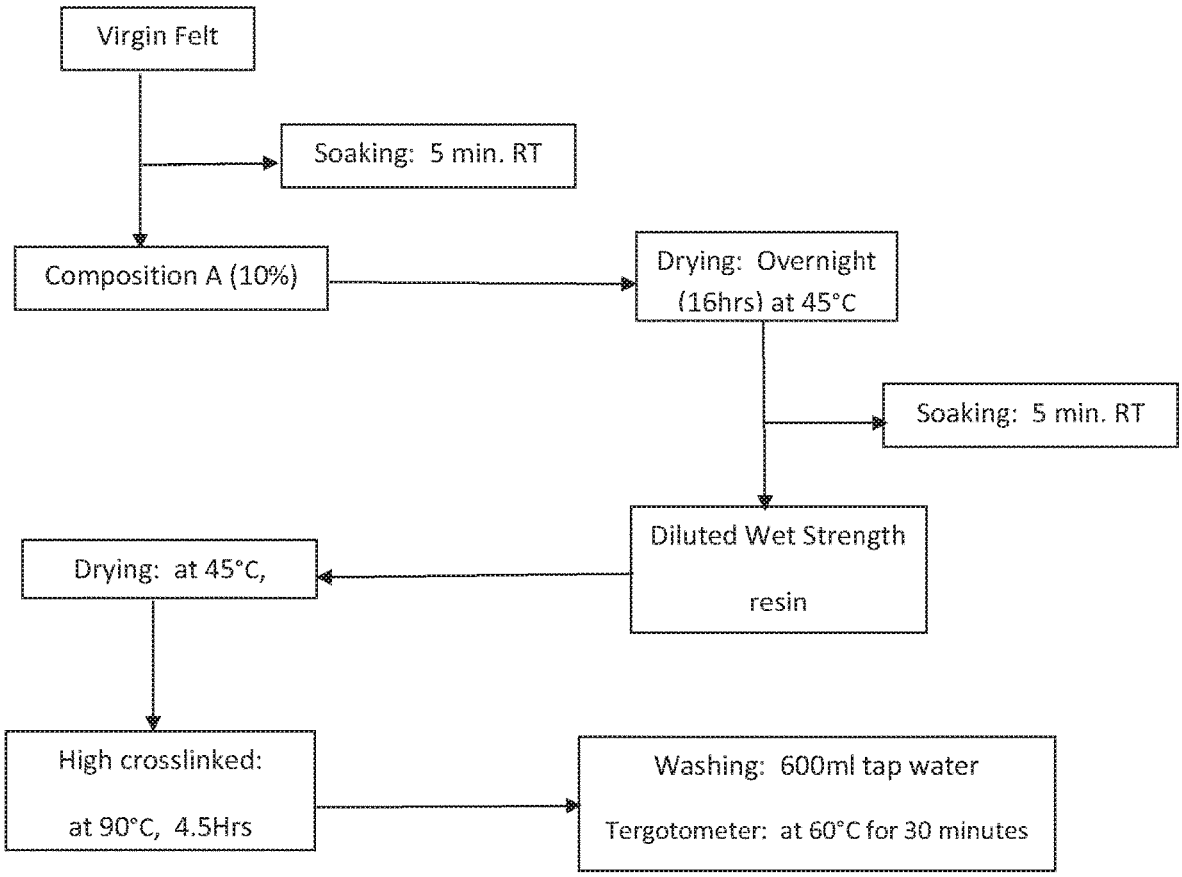
Virgin Felt
Soaking: 5 min. RT
Composition A (10%)
Drying: Overnight (16hrs) at 45°C
Soaking: 5 min. RT
Diluted Wet Strength resin
Drying: at 45°C,
High crosslinked: at 90°C, 4.5Hrs
Washing: 600ml tap water
Tergotometer: at 60°C for 30 minutes

COMPOSITION, ITS USE AND METHOD FOR REMOVING AND PREVENTING WET STRENGTH RESINS FROM CONTAMINATING PAPERMAKING EQUIPMENT

PRIORITY

This application claims priority of the U.S. provisional application No. 62/527,027 filed on Jun. 29, 2017, the content of which is incorporated herein by reference.

FIELD OF THE INVENTION

This invention relates to compositions and methods for cleaning wet strength resin contamination from papermaking equipment and/or for preventing wet strength resins from contaminating papermaking equipment.

BACKGROUND OF THE INVENTION

Wet strength resins are major additives used in the papermaking process. Use of wet strength resins, for example, polyamide-epichlorohydrin (PAE), results in buildup of crosslinked chemicals and fouling of wet press felts, causing the felts to lose permeability and decrease water absorption speed after a period of time. Paper mills spend time and money to clean the fouled felts and even have to change the felts frequently.

Chemical products that are currently used for wet press felt cleaning or cleaning wet strength resin contamination are either highly caustic or highly acidic. These chemical products are corrosive, not renewable or biodegradable, and are inappropriate for safe handling. Additionally, the products not only remove the wet strength resin contamination but may also damage the felt itself.

Thus, there is a need for products that are highly efficient in cleaning wet strength resin contamination from papermaking equipment and/or preventing wet strength resins from contaminating papermaking equipment, without appreciably damaging the equipment. Additionally, the products must be safe to handle and environmentally friendly, such as renewable and/or biodegradable.

SUMMARY OF THE INVENTION

One objective of the present invention is to provide solutions to or alleviate the problems encountered in the prior art.

In particular, one objective of the present invention is to provide a substantially biodegradable, safe and efficient composition for cleaning wet strength resin contamination from papermaking equipment and/or preventing wet strength resins from contaminating papermaking equipment.

A typical composition according to the present invention for cleaning wet strength resin contamination from papermaking equipment and/or for preventing wet strength resins from contaminating papermaking equipment, comprises an aqueous solution of a weak organic acid; a surfactant, preferably nonionic surfactant; a divalent metal ion containing catalyst; and optionally a glycol ether containing solvent.

A typical method according to present invention of cleaning wet strength resin contamination from papermaking equipment, the method comprises the steps of contacting the equipment with a composition comprising an aqueous solution of a weak organic acid; a surfactant, preferably a nonionic surfactant; a divalent metal ion containing catalyst and optionally a glycol ether containing solvent.

A typical method according to the present invention of preventing wet strength resins from contaminating papermaking equipment of a papermaking process, the method comprises the steps of contacting the equipment with a composition comprising an aqueous solution of a weak organic acid; a surfactant, preferably a nonionic surfactant; a divalent metal ion containing catalyst and optionally a glycol ether containing solvent, before and/or during and/or after addition of the wet strength resin in the papermaking process.

A typical use according to the present invention of a composition comprising an aqueous solution of a weak organic acid; a surfactant, preferably a nonionic surfactant; a divalent metal ion containing catalyst and optionally a glycol ether containing solvent, is for cleaning an equipment by contacting the equipment with the composition.

Compositions of the current invention have multiple advantages. The compositions are renewable, environmentally friendly and substantially biodegradable. The cleaning compositions are FDA compliant and thus are suitable for cleaning equipment used in making paper, board or the like to be used with food contact. The compositions are stable and highly efficient in cleaning wet strength resin contamination from papermaking equipment and in preventing wet strength resins from contaminating papermaking equipment, without damaging the equipment. The components of the composition may also show synergistic effect, wherein the composition may have higher cleaning efficiency or capacity than the individual components.

Other objects, features, and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE DRAWINGS

The following schematical drawings form part of the present specification and are included to further demonstrate certain aspects of the present invention. The invention may be better understood by reference to one or more of these drawings in combination with the detailed description of the specification embodiments presented herein.

FIG. 1: Felt conditioning process, as described in Example 2.

DETAILED DESCRIPTION OF THE INVENTION

The present invention provides stable, renewable, environmentally friendly, FDA compliant and safe to handle composition for cleaning wet strength resin contamination from papermaking equipment and/or preventing wet strength resins from contaminating papermaking equipment.

Certain embodiments of the invention are related to compositions for cleaning wet strength resin contamination from papermaking equipment and/or preventing wet strength resins from contaminating papermaking equipment, the composition comprising an aqueous solution of a weak organic acid; a surfactant, preferably a nonionic surfactant; a divalent metal ion containing catalyst, and optionally a glycol ether containing solvent. In certain embodiments the weak organic acid is selected from a group consisting of citric acid, adipic acid, glycolic acid and combinations thereof, preferably citric acid. In certain embodiments the glycol ether containing solvent is selected from a group consisting of diethylene glycol monobutyl ether, diethylene glycol monoethyl ether and a combination thereof. In certain embodiments the surfactant is selected from a group consisting of isotridecyl alcohol ethoxylate, dodecanol ethoxylate, ethoxylated 2,4,7,9-tetramethyl-5-decyne-4,7-diol, polyethylene glycol trimethylnonyl ether, polysorbates, ethoxylated secondary alcohols containing surfactants and combinations thereof. In certain embodiments the divalent metal ion is selected from a group consisting of $Ca^{+2}$, $Mg^{+2}$, $Ba^{+2}$, $Fe^{+2}$, $Cu^{+2}$, $Ni^{+2}$, $Mn^{+2}$ and $Co^{+2}$, preferably $Fe^{+2}$, $Ca^{+2}$, $Cu^{+2}$ or $Ni^{+2}$. In certain embodiments the weak organic acid concentration is within 15%-45%, preferably 20%-30%. In certain embodiments the glycol ether containing solvent concentration is within 0%-15%, preferably 3%-8%. In certain embodiments the surfactant concentration is within 2%-25%, preferably 5%-13%. In certain embodiments the divalent metal ion containing catalyst concentration is within 0.01%-5%, preferably 0.25%-3%. In certain embodiments such cleaning compositions are further diluted with one or more diluting agents wherein diluting agent: composition, weight:weight, ratio is in range 500:1-0:1, preferably 200:1-9:1.

Certain embodiments of the invention are related to methods of cleaning wet strength resins contamination from a papermaking equipment, the method comprising the steps of contacting the equipment with a composition comprising an aqueous solution of a weak organic acid; a surfactant, preferably a nonionic surfactant; a divalent metal ion containing catalyst, and optionally a glycol ether containing solvent. In certain embodiments the weak organic acid is selected from a group consisting of citric acid, adipic acid, glycolic acid and combinations thereof, preferably citric acid. In certain embodiments the glycol ether containing solvent is selected from a group consisting of diethylene glycol monobutyl ether, diethylene glycol monoethyl ether and a combination thereof. In certain embodiments the surfactant is selected from a group consisting of isotridecyl alcohol ethoxylate, dodecanol ethoxylate, ethoxylated 2,4,7,9-tetramethyl-5-decyne-4,7-diol, polyethylene glycol trimethylnonyl ether, polysorbates, ethoxylated secondary alcohols containing surfactants and combinations thereof. In certain embodiments the divalent metal ion is selected from a group consisting of $Ca^{+2}$, $Mg^{+2}$, $Ba^{+2}$, $Fe^{+2}$, $Cu^{+2}$, $Ni^{+2}$, $Mn^{+2}$ and $Co^{+2}$, preferably $Fe^{+2}$, $Ca^{+2}$, $Cu^{+2}$ or $Ni^{+2}$. In certain embodiments the weak organic acid concentration is within 15%-45%, preferably 20%-30%. In certain embodiments the glycol ether containing solvent concentration is within 0%-15%, preferably 3%-8%. In certain embodiments the surfactant concentration is within 2%-25%, preferably 5%-13%. In certain embodiments the divalent metal ion containing catalyst concentration is within 0.01%-5%, preferably 0.25%-3%. In certain embodiments such cleaning compositions are further diluted with one or more diluting agents wherein diluting agent:composition, weight:weight, ratio is in range 500:1-0:1, preferably 200:1-9:1. In certain embodiments cleaning is performed at elevated temperatures. In certain other embodiments contact time is between 0.1 second to 5 hours, preferably between 30 seconds to 1 hour, more preferably 1 minute to 30 minutes. In certain other embodiments the papermaking equipment is wet press felts, dryer fabric, papermaking equipment used in a papermaking process that uses wet strength resins or other papermaking machine surface. In certain embodiments the wet strength resin is polyamide-epichlorohydrin (PAE) resin.

Certain embodiments of the invention are related to methods of preventing wet strength resins from contaminating papermaking equipment of a papermaking process, the method comprising the steps of contacting the equipment with a composition comprising an aqueous solution of a weak organic acid; a surfactant, preferably a nonionic surfactant, a divalent metal ion containing catalyst, and optionally a glycol ether containing solvent, before and/or during and/or after addition of the wet strength resin in the papermaking process. In certain embodiments the weak organic acid is selected from a group consisting of citric acid, adipic acid, glycolic acid and combinations thereof, preferably citric acid. In certain embodiments the glycol ether containing solvent is selected from a group consisting of diethylene glycol monobutyl ether, diethylene glycol monoethyl ether and a combination thereof. In certain embodiments the surfactant is selected from a group consisting of isotridecyl alcohol ethoxylate, dodecanol ethoxylate, ethoxylated 2,4,7,9-tetramethyl-5-decyne-4,7-diol, polyethylene glycol trimethylnonyl ether, polysorbates, ethoxylated secondary alcohols containing surfactants and combinations thereof. In certain embodiments the divalent metal ion is selected from a group consisting of $Ca^{+2}$, $Mg^{+2}$, $Ba^{+2}$, $Fe^{+2}$, $Cu^{+2}$, $Ni^{+2}$, $Mn^{+2}$ and $Co^{+2}$, preferably $Fe^{+2}$, $Ca^{+2}$, $Cu^{+2}$ or $Ni^{+2}$. In certain embodiments the weak organic acid concentration is within 15%-45%, preferably 20%-30%. In certain embodiments the glycol ether containing solvent concentration is within 0%-15%, preferably 3%-8%. In certain embodiments the surfactant concentration is within 2%-25%, preferably 5%-13%. In certain embodiments the divalent metal ion containing catalyst concentration is within 0.01%-5%, preferably 0.25%-3%. In certain embodiments such cleaning compositions are further diluted with one or more diluting agents wherein diluting agent:composition, weight:weight, ratio is in range 500:1-0:1, preferably 200:1-9:1. In certain other embodiments contact time is between 0.1 second to 5 hours, preferably between 30 seconds to 1 hour, more preferably 1 minute to 30 minutes. In certain other embodiments the papermaking equipment is wet press felts, dryer fabric, papermaking equipment used in a papermaking process that uses wet strength resins or other papermaking machine surface. In certain embodiments the wet strength resin is polyamide-epichlorohydrin (PAE) resin.

Certain embodiments of the invention are related to use of a composition, comprising an aqueous solution of a weak organic acid; a surfactant, preferably a nonionic surfactant; a divalent metal ion containing catalyst, and optionally a glycol ether containing solvent, for cleaning an equipment by contacting the equipment with the composition. In certain embodiments the weak organic acid is selected from a group consisting of citric acid, adipic acid, glycolic acid and combinations thereof, preferably citric acid. In certain embodiments the glycol ether containing solvent is selected from a group consisting of diethylene glycol monobutyl ether, diethylene glycol monoethyl ether and a combination thereof. In certain embodiments the surfactant is selected from a group consisting of isotridecyl alcohol ethoxylate, dodecanol ethoxylate, ethoxylated 2,4,7,9-tetramethyl-5-decyne-4,7-diol, polyethylene glycol trimethylnonyl ether, polysorbates, ethoxylated secondary alcohols containing surfactants and combinations thereof. In certain embodiments the divalent metal ion is selected from a group consisting of $Ca^{+2}$, $Mg^{+2}$, $Ba^{+2}$, $Fe^{+2}$, $Cu^{+2}$, $Ni^{+2}$, $Mn^{+2}$ and $Co^{+2}$, preferably $Fe^{+2}$, $Ca^{+2}$, $Cu^{+2}$ or $Ni^{+2}$. In certain embodiments the weak organic acid concentration is within 15%-45%, preferably 20%-30%. In certain embodiments the glycol ether containing solvent concentration is within 0%-15%, preferably 3%-8%. In certain embodiments the surfactant concentration is within 2%-25%, preferably 5%-13%. In certain embodiments the divalent metal ion containing catalyst concentration is within 0.01%-5%, preferably 0.25%-3%. In certain embodiments such cleaning compositions are further diluted with one or more diluting agents wherein diluting agent:composition, weight:weight, ratio is in range 500:1-0:1, preferably 200:1-9:1. In certain embodiments cleaning is performed at elevated temperatures. In certain other embodiments contact time is between 0.1 second to 5 hours, preferably between 30 seconds to 1 hour, more preferably 1 minute to 30 minutes. In certain embodiments the equipment is a paper making equipment. In certain other embodiments the papermaking equipment is wet press felts, dryer fabric, papermaking equipment used in a papermaking process that uses wet strength resins or other papermaking machine surface. In certain embodiments the papermaking equipment contains contamination formed from use of wet strength resins in a papermaking process. In certain embodiments the wet strength resin is polyamide-epichlorohydrin (PAE) resin.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

In certain embodiments the equipment is a paper making equipment. In certain embodiments the papermaking equipment contains contamination formed from use of wet strength resins in a papermaking process.

The composition according to invention comprises an aqueous solution of a weak organic acid. The use of weak organic acid makes the composition more benign and safe, both for process operators and workers as well as for equipment which is to be cleaned. At the same time, however, it promotes the unexpectedly sufficient cleaning effect which is obtained with the composition. According to one preferable embodiment the organic acid concentration in the composition is within 10%-45%, preferably 20%-30%.

Weak organic acid of the current invention may have pKa greater than 1.5, preferably greater than 2, more preferably greater than 3. The weak organic acid may be dibasic or tribasic acid and it may have at least one pKa value in the range from 3 to 6. According to one embodiment of the invention the weak organic acid may be selected from a group consisting of citric acid, adipic acid, glycolic acid and any combinations thereof. Preferably the weak organic acid is citric acid.

The composition comprises further a surfactant, preferably a nonionic surfactant. The surfactant concentration in the composition may preferably be within 2%-25%, preferably 5%-13%. A surfactant, as referred in this disclosure, contains a hydrophilic head group and a hydrophobic tail group. Nonionic surfactants are surfactants with an uncharged hydrophilic head group and do not dissociate into ions in aqueous solutions. Preferable nonionic surfactants include ethoxylates, especially fatty alcohol ethoxylates, alkoxylates and cocamides. A surfactant useful for the current invention makes the components of the claimed composition miscible with each other, keeps them well dispersed and forms a micro-emulsion. The surfactants may also enhance the cleaning efficiency of the individual components of the composition.

According to one embodiment of the invention surfactant may be selected from a group consisting of isotridecyl alcohol ethoxylate, dodecanol ethoxylate, ethoxylated 2,4,7,9-tetramethyl-5-decyne-4,7-diol, polyethylene glycol trimethylnonyl ether, polysorbates, ethoxylated secondary alcohols-containing surfactants and any combinations thereof.

Suitable dodecanol ethoxylates are nonionic surfactants containing one or more moles of ethylene oxide per mole of dodecanol. In certain embodiments mole ratio of ethylene oxide and dodecanol is 7:1.

Suitable isotridecyl alcohol ethoxylates are nonionic surfactants containing one or more moles of ethylene oxide per mole of isotridecyl alcohol. In certain embodiments mole ratio of ethylene oxide and isotridecyl alcohol is 9:1.

Suitable polysorbates are nonionic surfactants composed of fatty acid esters of polyoxyethylene sorbitan. Examples of polysorbates are polyoxyethylene sorbitan monolaurate, polysorbate sorbitan monopalmitate, polyoxyethylene sorbitan monostearate, polyoxyethylene sorbitan monooleate.

In certain embodiments suitable polyethylene glycol trimethylnonyl ether may be polyoxyethylene 2,6,8-trimethyl-4-nonyl ether.

The composition comprises further a divalent metal ion containing catalyst. According to one embodiment the divalent metal ion containing catalyst concentration in the composition may be within 0.01%-5%, preferably 0.25%-3%. The divalent metal ion may be selected from a group consisting of $Ca^{+2}$, $Mg^{+2}$, $Ba^{+2}$, $Fe^{+2}$, $Cu^{+2}$, $Ni^{+2}$, $Mn^{+2}$, and $Co^{+2}$, preferably from a group of $Fe^{+2}$, $Ca^{+2}$, $Cu^{+2}$ and $Ni^{+2}$. The origin of the effect, which is obtained when the composition comprises a divalent metal ion containing catalyst, is not yet fully understood. However, it is speculated, without wishing to be bound by a theory, that either oxidation-reduction reactions or some chelating reactions might be involved.

The divalent metal ion containing catalyst may be in form of salt, where the counterion is any suitable organic or inorganic, divalent or monovalent anion, preferably citrate, acetate, maleate, sulphate or chloride, even more preferably sulphate or chlorate.

According to one preferable embodiment the composition comprises a glycol ether containing solvent. The glycol ether containing solvents may be selected from the group consisting of diethylene glycol monobutyl ether, diethylene glycol monoethyl ether, ethylene glycol monophenyl ether, diethylene glycol monophenyl ether, polyethylene glycol monophenyl ether, triethylene glycol monophenyl ether containing solvents and any combination thereof. Preferably, the glycol ether containing solvent is selected from the group consisting of diethylene glycol monobutyl ether, diethylene glycol monoethyl ether and any combinations thereof. The glycol ether containing solvent concentration in the composition may be within 0%-15%, preferably 0.01%-15%, more preferably 3%-8%.

The compositions of the current invention remove wet strength resin contamination and/or prevent wet strength resins from contaminating papermaking equipment through removal, prevention or reduction of formation of crosslinked chemicals from wet strength resins on the papermaking equipment.

The cleaning composition may be diluted before it is used for cleaning the papermaking equipment and brought into contact with the said equipment. Diluting agent may be selected from the group consisting of water, compatible chemicals, compatible chemical mixtures or premixtures, compatible liquids, compatible solids or combinations thereof, preferably water. "Compatible" are those that do not result in separation between the components of compositions and/or precipitation, and maintain the micro-emulsion state of the composition while and/or after adding and/or mixing those to the composition. According to one embodiment of the invention diluting agent:composition ratio, given weight:weight, is in range 500:1-0:1, preferably 200:1-9:1.

The composition is contacted with an equipment, preferably with a papermaking equipment. The contacting may be carried out by spraying the composition onto the equipment surface, by soaking or immersing the equipment into the composition or by applying the composition to a circulating process flow, which comes into contact with the equipment.

According to one embodiment of the invention the cleaning is performed at an elevated temperature. This means that the composition and/or the equipment are at an elevated temperature at the time of cleaning. Cleaning at elevated temperatures is performed through heating the cleaning composition or equipment being cleaned, or both, at elevated temperature before and/or while in contact with each other. The cleaning compositions or equipment being cleaned, or both, are heated to temperatures between above room temperature to below 130° C., preferably between 45° C. to 70° C., more preferably between 50° C. to 60° C. At the preferred temperature range, energy optimized cleaning performance is observed.

Contact time depends on the area of the equipment being cleaned, the type of equipment surface being cleaned and/or contamination level of the equipment. Contact method depends on the equipment being cleaned. The contact method may be soaking, spraying or any other suitable contact method, as described above. Contact time is optimized such that optimum cleaning is obtained with minimum loss in production time. According to one embodiment the contact time may be between 0.1 second to 5 hours, preferably between 30 seconds to 1 hour, more preferably 1 minute to 30 minutes.

The composition of the present invention is preferably used for cleaning papermaking equipment, especially papermaking equipment that contains contamination formed from use of wet strength resins in a papermaking process. The equipment to be cleaned may be wet press felt, dryer fabric or any papermaking equipment used in a papermaking process that uses wet strength resins, or other papermaking machine surface. Preferably the composition is used for cleaning wet press felts or dryer fabrics.

The composition according to the invention is preferably used for cleaning contamination caused by wet strength resin, especially when the wet strength resin is polyamide-epichlorohydrin (PAE) resin.

Definitions

The use of the word "a" or "an" when used in conjunction with the term "comprising" in the claims and/or the specification may mean "one," but it is also consistent with the meaning of "one or more," "at least one," and "one or more than one."

Throughout this document, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this disclosure, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Percentages of components in compositions described throughout this application are weight percentages of the components in the compositions. Weight percentages are calculated with the assumption that the components contain no impurities.

EXAMPLES

The following examples as well as the figures are included to demonstrate preferred embodiments of the invention. It should be appreciated by those of skill in the art that the techniques disclosed in the examples or FIGURES represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Example 1: Cleaning of Wet Press Felts

Four sets of felt samples, with each set containing 2 samples, were used for this study. Circular felt samples with around 2" diameter were randomly die-cut from the bulk felt samples. Three sets were from tissue and towel producing paper mills (Mill 1-3). The remaining set was virgin felts contaminated with PAE in the laboratory (VF). The circularly cut virgin felt samples were soaked in PAE solution, followed by heating in a 105° C. oven for 2.5 hours to promote cross-linking.

Each felt sample was washed and tested separately. A tergotometer was used to wash the felt samples. Loose fibers were collected between the wash and rinse cycles. This fiber collection was rolled into a small ball, dried, weighed, and recorded as "fiber loss" in the results. The results reported for contaminant removal are corrected for the fiber loss.

One felt sample from each set was washed with 5% (w/w) of composition A (Table 1). The composition was diluted with tap water. The other felt sample from each set was washed with tap water and was used as control for comparison. The felts were placed in separate washing containers and were placed in the tergotometer. The tergotometer was run at 60° C. for 30 minutes for the first washing step; pH was checked and recorded for each container. The container contents were then poured over a vacuum sieve to collect the felt samples and the loose fibers. The samples and container were rinsed with tap water and the samples were placed back in the container for the rinse cycle at the same temperature for 15 minutes; pH was checked and recorded for each container. Again, the contents of these containers were poured over a vacuum sieve to collect the felt samples and the loose fibers.

The mass of each felt sample was recorded pre- and post-wash. The felt fiber loss was collected at the end of each wash and rinse cycle and weighed as a fiber loss percentage. This fiber loss percentage indicates how harsh the chemical treatment was for the felt. Fiber loss was partially due to the harshness of the chemical treatment and partially due to the fact the felts were used felts from mills used in wash studies and were not brand new. After accounting for fiber loss, the remaining difference in felt mass between pre- and post-wash measurements is attributed to contaminant removal and reported as such. Ideally, the chemical treatment removes the greatest amount of contaminant without causing too much fiber loss and damage to the felt. Percentage contaminant removed and fiber loss percentages are reported in Table 2 and 3, respectively and were calculated as $$\%\ \text{Contaminant removed} = \frac{100 \times \left[\begin{array}{c}\text{initial weight (g)} - \\ (\text{final weight (g)} + \text{collected fiber weight (g)})\end{array}\right]}{\text{initial weight (g)}}$$

$$\%\ \text{Fiber Loss} = \frac{100 \times \text{collected fiber weigh (g)}}{\text{initial weight (g)}}$$

Porosity (or air permeability) test was conducted on pre- and post-wash felts using a Gurley Precision Porosity tester with a digital timer. The test was conducted with air passing through the individual felt sample. A digital timer records the length of time for a controlled volume of air to pass through the sample. The pre-wash porosity accounts for any contamination of felts, which would block the felt pores. The post-wash test indicates the porosity after targeted contaminant removal. Thus, comparing pre- and post-wash porosity is indicative of overall contaminant removal. The porosity time was recorded in Gurley seconds and was compared for pre- and post-wash. The lower the Gurley porosity seconds, the more porous the felts are. Cleaner felts should have higher porosity, thus lower Gurley porosity seconds indicate better cleaning ability. Gurley porosity seconds are reported in Table 4.

Water absorption speed was performed on pre- and post-wash felts as well. 100 ml fresh deionized water was added to an 8 oz straight-sided, wide-mouth jar. Felt samples were manually flattened and were placed on top of the water surface using tweezers. The time between initial touching of felts on water surface and the start of sinking of felt samples was recorded. As is often the case, the felts may be too contaminated (even after a wash) and too hydrophobic to allow water to permeate the fabric. If the test runs over 180 seconds, a ">180 s" or "failed water absorption speed test" was reported. This test helps to indicate how easily the felt sample would absorb water by how "open/free" the felt was and how hydrophilic or hydrophobic the felt was after comparing pre- and post-wash measurements. Cleaner felts have higher water absorption speed (more open sites for water to absorb because less contaminants are holding those sites), and thus water absorption seconds would be lower. Water absorption seconds are reported in Table 5.

Results in Table 2 show that wash with 5% of Composition A removes significantly higher percentage of contaminants compared to the control. Results in Table 3 show fiber loss percentage for wash with 5% of Composition A, for all types of tested felts, were very low, and were similar to that of the control. Results in Table 4 show porosity of the felts increased (Gurley porosity seconds decreased) more compared to the control, by washing with 5% of Composition A. Results in Table 5 show water absorption speed of the felts increased (water absorption seconds decreased) significantly compared to the control, by washing with 5% of Composition A. Thus, Composition A cleans contaminants from the felts (Tables 2, 4 and 5) without appreciably damaging the felts (Table 3).

Example 2: Preventing Wet Strength Resins from Contaminating Wet Press Felts

Virgin felt samples with around 2" diameter were cut by a standard die cutter. One set of samples were then placed into a 10% (w/w) aqueous solution of Composition A and another set in water, used as control. The samples were soaked for five minutes at room temperature and dried overnight (16 hours) in a 45° C. oven. Wet strength chemical, PAE, was diluted using deionized water. The dried soaked felts were placed into the diluted PAE solution (2.5% w/w) and soaked for five minutes at room temperature, then dried for 6.5 hours in a 45° C. oven and then crosslinked in 90° C. oven for 4.5 hours. Felts were washed at 60° C. in 600 ml tap water for 30 minutes at 150 rpm in tergotometer (FIG. 1). Fiber loss, porosity and water absorption speed were measured with processes as described in Example 1. Percentage weight increased was calculated as $$\%\ \text{Weight Increased} = \frac{100 \times \left[\begin{array}{c}(\text{final weight (g)} + \text{collected fiber weight (g)}) - \\ \text{initial weight (g)}\end{array}\right]}{\text{initial weight (g)}}$$

Percentage weight increased, fiber loss, Gurley porosity seconds and water absorption seconds are reported in Table 6. Percentage weight increased, for felts that were placed in 10% aqueous solution of Composition A were lower compared to control felts (felts that were placed in water instead of 10% aqueous solution of Composition A). Porosity and water absorption speed of felts that were placed in 10% aqueous solution of Composition A were higher (Gurley porosity seconds and water absorption seconds lower) compare to the control. These results show Composition A prevents PAE from contaminating the felts. Fiber loss percentages for felts that were placed in 10% aqueous solution of Composition A were lower compared to the control. This shows that the Composition A does not damage the felts.

TABLE 1

| Composition A | |
|---|---|
| | Weight % |
| Water | 61.5 |
| Citric acid | 25 |
| Isotridecyl alcohol ethoxylate (9 EO) | 5 |
| Diethylene glycol monobutyl ether | 5 |
| Carbowet GA-211 (Air Products) | 3 |
| FeSO4 | 0.5 |

TABLE 2

| Contaminant (%) removed | | | | |
|---|---|---|---|---|
| | Mill 1 | Mill 2 | Mill 3 | VF |
| Comp. A (5%) | 1.03 | 2.16 | 1.81 | 1.032 |
| Control | 0.87 | 1.42 | 1.41 | 0.485 |

TABLE 3

| Felt Fiber loss (%) | | | | |
|---|---|---|---|---|
| | Mill 1 | Mill 2 | Mill 3 | VF |
| Comp. A (5%) | 0.83 | 0.76 | 0.68 | 0.97 |
| Control | 0.84 | 0.51 | 0.62 | 0.65 |

TABLE 4

| Gurley Porosity (s) | | | | | | | | |
|---|---|---|---|---|---|---|---|---|
| | Mill 1 | | | | | | | |
| | Before wash | After wash | Mill 2 Before wash | Mill 2 After wash | Mill 3 Before wash | Mill 3 After wash | VF Before wash | VF After wash |
| Comp. A (5%) | 9.86 | 8.67 | 12.30 | 9.42 | 12.98 | 10.88 | 7.62 | 9.43 |
| Control | 9.98 | 9.52 | 14.73 | 13.17 | 13.43 | 11.81 | 7.62 | 10.00 |

TABLE 5

| Water Absorption Speed (s) | | | | | | | |
|---|---|---|---|---|---|---|---|
| | Mill 1 | | Mill 2 | | Mill 3 | | VF |
| | Before wash | After wash | Before wash | After wash | Before wash | After wash | After wash |
| Comp. A (5%) | 11.82 | 3.54 | 3.30 | 2.64 | >180 | 7.76 | 5.06 |
| Control | 10.91 | 45.73 | 3.15 | 3.40 | >180 | >180 | 102.68 |

TABLE 6

| Preventing PAE crosslinking on Virgin Felts | | | | | | |
|---|---|---|---|---|---|---|
| | Weight increased | Fiber Loss | Gurley Porosity (s) | | Water Absorption (s) | |
| Formulation | (%) | (%) | Average | STDEV | Average | STDEV |
| Control | 2.73 | 0.74 | 8.15 | 0.42 | 319.310* | 14.22 |
| Comp. A (10%) | 2.21 | 1.25 | 8.00 | 0.32 | 4.21 | 0.33 |

*For the control, the water absorption spend test were run longer than 180 seconds.

The invention claimed is:

1. A composition for cleaning wet strength resin contamination from a papermaking equipment and/or for preventing wet strength resins from contaminating the papermaking equipment, the composition comprising:

an aqueous solution of a weak organic acid, wherein the organic acid concentration is within 20%-30%, a surfactant, wherein the surfactant concentration is within 5%-13%, a divalent metal ion containing catalyst, and wherein the divalent metal ion containing catalyst concentration is within 0.25%-3%, and optionally a glycol ether containing solvent.

2. The composition of claim 1, wherein the organic acid is selected from a group consisting of citric acid, adipic acid, glycolic acid and combinations thereof.

3. The composition of claim 1, wherein the surfactant is selected from a group consisting of isotridecyl alcohol ethoxylate, dodecanol ethoxylate, ethoxylated 2,4,7,9-tetramethyl 5 decyne-4,7-diol, polyethylene glycol trimethylnonyl ether, polysorbates, ethoxylated secondary alcohols containing surfactants and combinations thereof.

4. The composition of claim 1, wherein the divalent metal ion is selected from a group consisting of $Ca^{+2}$, $Mg^{+2}$, $Ba^{+2}$, $Fe^{+2}$, $Cu^{+2}$, $Ni^{+2}$, $Mn^{+2}$ and $Co^{+2}$.

5. The composition of claim 1, wherein the glycol ether containing solvent is selected from the group consisting of diethylene glycol monobutyl ether, diethylene glycol monoethyl ether and a combination thereof.

6. The composition of claim 1, wherein glycol ether containing solvent concentration is within 3%-8%; rest being water.

7. The composition of claim 1 further comprising a diluting agent, wherein the diluting agent is selected from the group consisting of water, compatible chemicals, compatible solids, compatible liquids and combinations thereof.

8. The composition of claim 7, wherein the diluting agent:composition, weight:weight, ratio is in a range 500:1-0:1.

9. The composition of claim 1, wherein the surfactant is a nonionic surfactant.

10. A method for cleaning wet strength resin contamination from a papermaking equipment and/or for preventing wet strength resins from contaminating the papermaking equipment of a papermaking process, the method comprising the steps of contacting the equipment with a composition comprising:

an aqueous solution of a weak organic acid, wherein the organic acid concentration is within 20%-30%, a surfactant, wherein the surfactant concentration is within 5%-13%, a divalent metal ion containing catalyst, and wherein the divalent metal ion containing catalyst concentration is within 0.25%-3%, and optionally a glycol ether containing solvent.

11. The method of claim 10, wherein the composition and/or the equipment are at an elevated temperature.

12. The method of claim 10, wherein contact time is between 30 seconds to 1 hour.

13. The method of claim 10, wherein the equipment is wet press felts or other papermaking machine surface.

14. The method of claim 13, wherein the papermaking equipment contains contamination formed from use of wet strength resins in a papermaking process.

15. The method of claim 14, wherein the wet strength resin is a polyimide-epichlorohydrin (PAE) resin.

16. The method of claim 10, wherein the surfactant is a nonionic surfactant.

17. A method of preventing wet strength resins from contaminating a papermaking equipment in a papermaking process, wherein the method comprises a step of contacting the equipment with a composition of claim 1, before and/or during and/or after addition of a wet strength resin in the papermaking process.

18. The method according to claim 17, wherein the wet strength resin is a polyimide-epichlorohydrin (PAE) resin.

* * * * *